US005187903A

United States Patent [19]

Holm

[11] Patent Number: 5,187,903

[45] Date of Patent: Feb. 23, 1993

[54] METHOD FOR REMOVING ACCUMULATED ASH FROM PRECIPITATORS

[75] Inventor: William D. Holm, Houston, Tex.

[73] Assignee: Allwaste, Inc., Tex.

[21] Appl. No.: 862,079

[22] Filed: Apr. 2, 1992

[51] Int. Cl.[5] ..... B24C 1/00

[52] U.S. Cl. ..... 51/320; 51/321

[58] Field of Search ..... 51/410, 413, 424, 427, 51/319, 320, 321, 281 R

[56] References Cited

U.S. PATENT DOCUMENTS 2,600,358 6/1952 Bolton ..... 51/321

4,333,743 6/1982 Nojima ..... 51/319

*Primary Examiner*—Bruce M. Kisliuk

*Assistant Examiner*—Jack Lavinder

*Attorney, Agent, or Firm*—Mark A. Oathout; John R. Kirk, Jr.

[57] ABSTRACT

The invention relates to a method of removing accumulated ash from a precipitator which includes the step of blasting the precipitator with air entrained with a particulate. The particulate is the fines accumulated from processing iron ore to make steel which is comprised of wustite, spinel, larnite and bredigite (sintered iron ore fines).

11 Claims, 3 Drawing Sheets

METHOD FOR REMOVING ACCUMULATED ASH FROM PRECIPITATORS

BACKGROUND OF THE INVENTION

Precipitators have long been used to remove dust particles from combustion gases and air. A particularly important application for precipitators is found in electric power generating plants. Electric power generating plants burn coal to create steam to power generators. The combustion gases from the coal are laden with fly ash. The fly ash must be removed from the gases before the gases are released to the atmosphere through the power plant chimney. Precipitators are the devices used to remove this fly ash.

Electrostatic precipitators produce an electric charge on the particles to be collected and then propel the charged particles by electrostatic forces to collecting plates. A discharge electrode or cathode is set up between collecting plates or the anode. An intense, high voltage electrical field is maintained between the discharged electrode and the collecting plates. The flue gas carrying the fly ash is ionized by the intense, electric field. The gas ions charge the entrained particles. The negatively charged particles still in the presence of the electrostatic field are attracted to the positively charged collecting plates. Periodically rappers come down and bang the collecting plates to loosen and drop the collected particles down into storage hoppers. The collection efficiency of the electrostatic precipitator is related to the time the particles are exposed to the electrostatic field, the strength of the field, and the resistivity of the particles. Therefore it is desirable to keep the strength of the electrostatic field as high as possible or maintain the maximum differential between the cathode and the collection plates.

When a certain differential is attained sparking will begin to occur. Sparking is a luminous discharge which occurs as a result of the omission of electrons at high potentials. The computer center controlling the voltage in the cathode wires uses TR sensors to count the number of sparks per minute in a field. For example they may be set for a count of 20 to 40 sparks per minute. If there are less than 20 sparks per minute then the precipitator is not running at maximum efficiency (typically 99.7% efficiency is the goal in a precipitator). At a certain voltage a corona will appear. A corona is a luminous discharge in the space surrounding a high voltage conductor caused by ionization of the gas medium. The discharge constitutes a loss of energy. The corona being caused by the emission of electrons is dependant upon the curvature of the conductor surface, with most emission occurring from sharp points and the least from surfaces with a large radius of curvature. The corona is usually accompanied by a blue glow and a crackling or hissing sound.

Once voltage begins to exceed preferred levels a dangerous potential is being reached which can lead to arcing. An arc is a sustained luminous discharge between the cathode and the collection plates. Because it is sustained rather than intermittent, an arc is distinguished from a spark discharge (the later being a series of discharges or sparks even when it appears continuous). An arc can actually puncture through a material such as the collection plates. So once again to prevent arcing the control unit is trying to minimize sparking and still maintain efficiency.

Now keeping in mind that corona and arcing are dependent upon the radius of curvature of the anode and cathode and upon the potential between the cathode and the collection plates some of the problems encountered in maintaining a precipitator at maximum efficiency will be appreciated. For instance, the fly ash building up on the collection plate may not build up uniformly or some of the fly ash accumulates on the plates irregardless of rapping. This build-up and accumulation will create points which increase the propensity for arcing. Depending upon the type of coal being burned the ash build up will effect the conductivity or resistivity of the medium between the cathode collection plates.

The accumulated ash essentially creates two voltage drops, one between the cathode and the surface of the build-up and the other between the surface of the build-up and the collection plate. When the later potential reaches a critical value a back corona or a positive corona off of the collection plate can be created. Positive coronas are very unstable and result in poor efficiency of the precipitator. Any edge created on the collection plate will significantly increase the propensity for arcing between the wires and the collection plate and the voltage of the entire field must be limited to prevent the arcing. If you have a point or edge no matter how minute it's going to increase the propensity for arcing.

Another factor which needs to be considered is that different coals burned in the power plants have different characteristics. For instance some coals have more sulphur than others. When this coal burns the sulphur gets on the fly ash and acts as a conductor. Coals also include sodium which also may act as a conductor. Soda ash can be injected into the flue gas to increase the amount of sodium. Sulphur can be injected as a technique to control resistivity. So one can see that the composition of the coal and therefore the composition of the fly ash affects the resistivity of the electrostatic field.

The larger the resistivity, the greater the propensity to get a back corona. This is because the accumulated ash will create a larger voltage drop due to a high resistivity layer. On the other hand one does not want the resistivity to be too low because the ash build-up should be somewhat sturdy so that when the rapper strikes the collection plate the packed fly ash will drop as a sheet into the hopper rather than vortexing back into the gases passing through the precipitator and out the chimney.

As an example plates may be 30 feet high and 10 feet wide. The ash building up on the plate may build up excessively from, for example, a half to one inch thick. If the ash is correctly packed and rapped the sheet of ash will fall down into the hopper. A little bit of the ash will move back into the flue gas and move downstream to the next precipitator in series. However the rapping must be controlled since it can damage the plate or the wires or if the rapping occurs too soon the accumulated ash may not properly pack. Sulphur dioxide contained in the ash combined with moisture causes corrosion which the rappers won't take off. Over time the ash accumulates on the surface of the plates.

The collection plates are electrically connected in fields with typically three to five fields in series. If the first field captures 70% of the fly ash then the second field theoretically would capture 70% of the remaining 30% which is 21%. Now with the remaining 9%, 70% of it is captured by the third field and the remaining 2 to 3% is reduced by 70% in the last precipitator before the gasses pass out of the chimney. So the first set of plates will be collecting a much higher volume than the outlet plates and therefore will be the dirtiest.

It must also be considered that resistivity is a function of temperature and since a certain amount of resistivity is desired, depending upon the type of coal or coal chemistry, the flue gas temperatures flowing through the precipitators may be controlled so that a desired resistivity is obtained.

Because of ash accumulations in the precipitator and the resulting effect upon the efficiency of the precipitator, precipitators should periodically be cleaned. Going back about eight years or so most of the precipitators were water washed meaning they would either be cleaned by hydroblasting or with a high pressure fire type hose. One of the problems with water washing is that all of the water ends up dropping into the hoppers. In most cases hoppers use a dry pneumatic system to move out the ash. Wet fly ash becomes hard like cement which can damage this dry pneumatic system. Procedures required to prevent water from entering the system are very time consuming, very labor intensive and expensive. In most cases the water washing of a precipitator including dry out time could not be completed in a weekend. Water washing requires much more time than blasting. Another problem was the water combining with the sulphur and the ash to create sulfuric acid. This lead to corrosion and rust problems on the plates. Water washing is still used in some plants.

Because of the long periods of down time for cleaning the precipitators, the business was previously seasonal. Extreme temperature variations of the summer and winter create peak demands preventing shutdown for extended periods. So there were two time periods per year that the majority of the cleaning work would be done.

Within the last few years Applicant utilized sand blasting for the cleaning of precipitators. Sandblasting eliminated the above-discussed problems that are encountered with water washing. However sand blasting has other problems. Sand contains a large amount of free silica and therefore when the sandblasting was carried out large amounts of free silica dust was generated. Free silica is a hazardous substance which is known to cause silicosis and which is strictly regulated by governmental agencies. Sand is also very abrasive. The blasting velocities needed to clean the precipitators combined with the abrasivity of sand scores the plates and may blow holes in the plates. The abrasion of the plate creates tiny peaks which the ash builds upon to increase the propensity of sparking. One small hole in one collection plate will affect an entire electrostatic field because it will be the point which begins to arc first. The collection plates are very thin, anywhere from 16 to 22 gauge. It's dark and dusty when a worker is actually in the precipitator cleaning the collection plates so it's very difficult to see what is being blasted while you're trying to get the entire plate clean. It is much easier to destroy to wear the proximal end of the plate than to destroy or wear the distal end of the plate although both must be equally clean. You also get a build-up on the wire, which may for example be one eighth inch wire, which is called "donuts." The build-up and blasting of the wires can lead to breaking of the wires which also limits or kills the entire electrostatic field. Lastly, the sandblasting technique leaves a sandy film or residue on the wires or collection plates. Since sand is relatively resistive this resistive residue layer enhanced arcing and back corona related problems.

The use of grains and walnut shells in the blasting of precipitators has also been used within the last few years. The use of this technique is considered to be very dangerous because of grain dust build-up which upon ignition could create an explosion.

There has also been prior art attempts to use carbon dioxide, dry ice in the frozen state. This simply did not work because the dry ice would evaporate before it could clean the collecting plates.

The need therefore existed for a method of cleaning precipitators which could be carried out quickly, thoroughly, without releasing large amounts of free silica, without damaging (abrasion or corrosion) the wires and collection plates, without the release of combustible dust, and which relatively speaking would leave a resistivity less than that of sandblasting.

SUMMARY OF THE INVENTION

The invention relates to a method of removing accumulated ash from a precipitator which includes the step of blasting the precipitator with air entrained with a particulate. The particulate is the fines accumulated from processing iron ore to make steel.

DETAILED DESCRIPTION OF THE INVENTION

Figure 2:
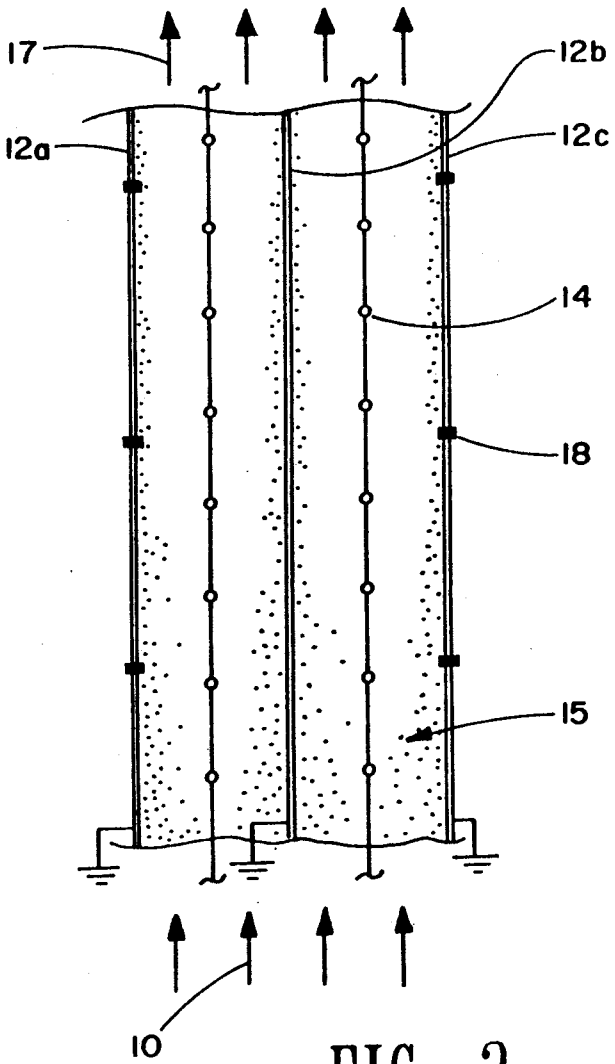
FIG. 2 is a concept view from the top of a precipitator.
Figure 1:
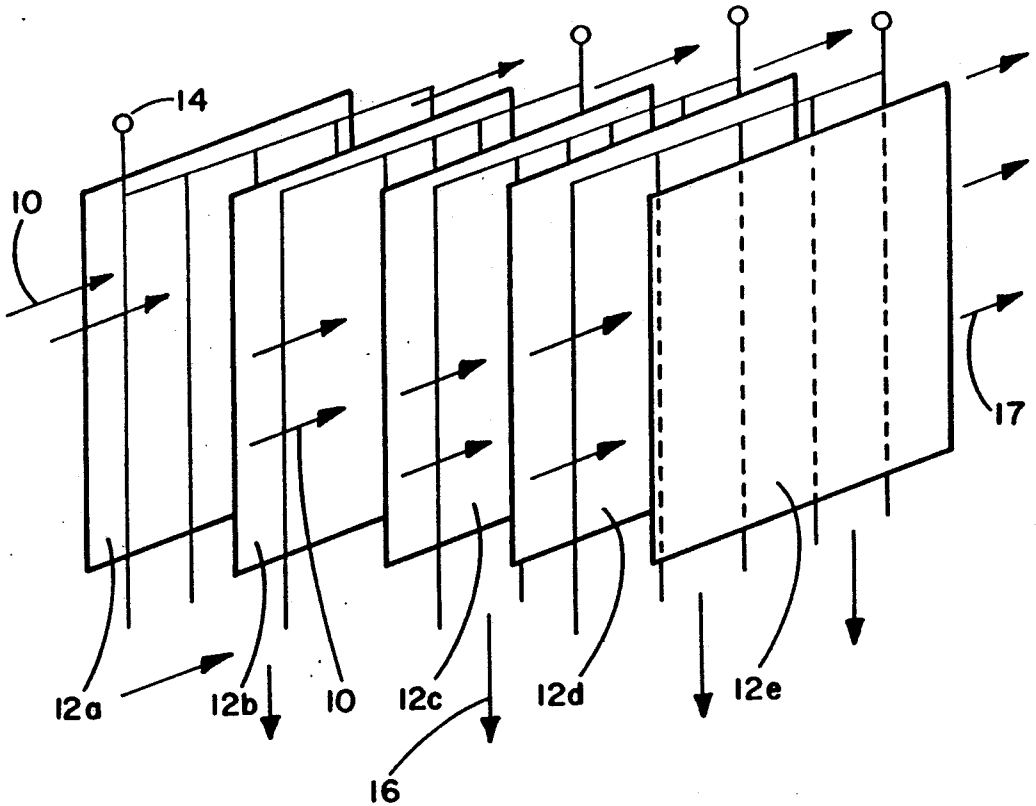
FIG. 1 is a concept view of a precipitator in perspective.

Referring to FIG. 1 a simplified precipitator is depicted. Flue gas containing fly ash (arrows 10) is moved through the area between the collector plates 12*a*, 12*b*, 12*c*, 12*d* and 12*e*. The flue gas is negatively charged by the high voltage electrodes or wires 14. The ionized or charged particles 15 (FIG. 2) are then attracted to the positively charged or grounded collector plates 12*a*–12*e*. Mechanical shaking of the collector plates 12*a*–12*e* causes the fly ash to fall (as depicted by arrows 16) to the bottom of the precipitator into hoppers (not shown). The flue gas now primarily cleansed of the fly ash and dust particles, emerges from the plates (arrows 17) and rises up the chimmey while the fly ash is pneumatically conveyed to a storage silo for further utilization or disposal. FIG. 2 shows three collection plates 12*a*, 12*b* and 12*c*, with intermediate electrodes 14. Ribs 18 support the collection plates 12*a*, 12*b* and 12*c*.

Figure 3:
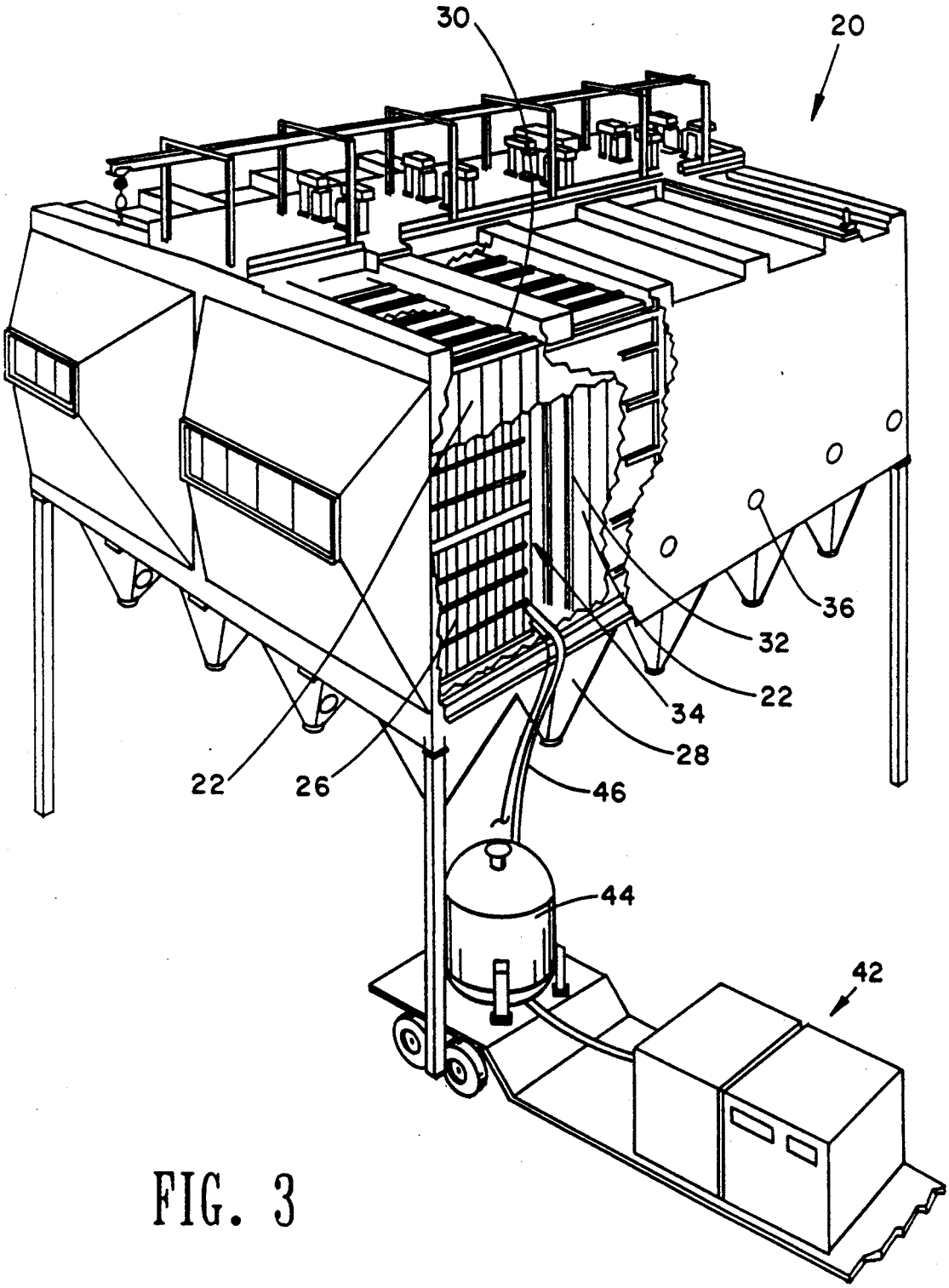
FIG. 3 is a perspective view of a precipitator and the trailer utilized in the invention described herein.

Referring to FIG. 3 an electrostatic precipitator 20 is shown. A typical precipitator may be 75 feet wide by 150 feet long. The electrostatic precipitator includes parallel collection plates 22, rappers (not shown), discharge electrodes or wires 26 and hoppers 28. The precipitator 20 will have a large number of collection plates 22 in parallel. Additional fields or sets of plates and wires are connected in series with a small opening between the ends 30 and 32 of the collection plates 22. This opening provides access to a walkway 34 for workers for the cleaning of the precipitator plates 22 between each sets of plates 22. This opening may be anywhere from 15 to 30 inches wide. A covered porthole 36 allows access to the walkway 34. Below the hoppers 28 the ash is pneumatically conveyed out (system not shown).

Referring back to FIG. 2 the distance between the collection plates 12 may be nine inches although this distance can vary. The wire would be centered between plates in an ideal system. The height of the collection plates can vary from approximately 20 feet on up to 50 feet tall. In most cases there is access from the top of the precipitator which you can crawl into and blast down into the precipitator. Typical collection plates are about 12 feet wide and since you can blast from both ends a worker must blast approximately six feet from each end. However the wires also pose a problem since you must blast beyond the wires. The wires may be spaced for example about every 18 inches. Steel bottles (not shown) hand from the bottom of the wires to hold them straight. The bottles must be blasted as well.

A trailer 40 as shown in FIG. 3 is utilized with the invention. The trailer 40 includes a 1600 CFM, 120 PSI air compressor connected in line to a dryer (both within housing 42) which is connected in line to a sand pot 44. One and a half ton sacks (not shown) of the particulate utilized in the invention are opened and emptied into the pot 44. The compressed air is fed from the compressor through the dryer to remove moisture from the air and particulate. The particulate is fed through a mixing valve into a stream of compressed air as is known to one of ordinary skill in the art. The particulate entrained in the compressed air is then fed through a one and a quarter inch I.D. hose 46 which runs to the worker carrying out the blasting procedure.

To date, there is only one known supply of the particulate utilized in the inventive process. This supply is a stockpile located at CF&I Steel Corporation in Pueblo, Colo. The supply is believed to be flue dust or fines stockpiled for a separate commercial venture. At one time there were hopes to further process these fines by "popping" them like popcorn which makes the particulate bigger and very porous with the same weight to make aggregate. The aggregate was then hoped to be used in the making of lightweight concrete. This commercial venture went sour. It is believed the stockpile of fines has been sitting unused for a period of approximately 10 years. The fines came from an integrated steel mill.

An integrated steel mill takes its metal from iron ore (as compared to mills which are currently operated which make steel from scrap). Once the iron ore is fed through the furnace, fines or flue dust is created. Iron ore fines contain iron oxide and other metals used in the steel making process. In the past these fines were reprocessed and fed back into the furnace to recuperate iron and other metals. The stockpiled fines utilized in the present invention were never fed back to the furnace and were not further processed for the making of lightweight aggregate. However the fines were reprocessed through oreprep by sintering to fuse the fines. This particulate was then stockpiled. The sintered fines formed a porous and coalescent matter. There are a few integrated steel mills still operating but Applicant is not aware of any stockpiling of the sintered fines.

Applicant took a sample of the fines and had a laboratory analysis carried out to determine the free silica content of the fines. Current governmental standards prohibit free silica concentration levels above 0.05 milligrams per cubic meter of air breathed in an eight hour work day. The results of that lab analysis follows:

| Parameter | | Units | Soil |
|---|---|---|---|
| Fe | iron | wt % | 24 |
| Mn | manganese | wt % | 3.01 |
| Al | aluminum | wt % | 0.58 |
| P | phosphorous | wt % | 0.38 |
| Ca | calcium | wt % | 18.46 |
| Mg | magnesium | wt % | 1.58 |
| $SiO_2$ | free silica | wt % | 0.07 |

Since the free silica content was within safe levels Applicant then took the next step and had a material safety data sheet prepared on the sample. The results of that analysis follows:

| Hazardous Components (Specific Chemical Identity; | Common Name(s) | OSHA PEL | % (optional) |
|---|---|---|---|
| FeO | Wustite | 10 mg/m$^3$ | 20 |
| $(R^{2+})(R^{3+})_2O_4$ R may be Fe, Mg, Al, Zn, and/or Cr | Spinel/ magnetite | | 25 |
| $Ca_2SiO_4$ | | | 20 |
| $Ca_2SiO_4$ | Larnito | | 7 |
| $(Ca,Fe,Mg)_2SiO_4$ | Bredigite | | 15 |
| Nuisance Dust Particles | | 10 mg/m$^3$ | |
| Specific Gravity ($H_2O$ = 1) 3.42 | | | |

The material safety data analysis also yielded favorable results and the material was subsequently field tested. During the field testing it was discovered that the material was a vitreous matter in the sense that it was hard and brittle (but it is not transparent although lack of transparency has no bearing on the invention). The fines actually have a specific gravity greater than that of silica.

When blasting the particulate the degree of abrasivity relative to sandblasting is much less severe because the particulate shatters upon impact with the collection plates and wires. The particulate can then be air blown out of the system.

In one test a one quarter inch steel plate was blasted, side by side, with one nozzle running sand and another nozzle running the flue dust particulate. The sand ate through the plate much quicker than the particulate.

During the testing it was also discovered that experts believed this particulate eliminated resistivity problems caused by sandblasting. The resistivity of the flue dust film remaining on the collection plates and wires after blasting is of a much lesser degree than the resistivity of the sand residue. It is believed the flue dust particulate is less resistive than sand. It is also possible that the flue dust particulate is leaving less of a residue or film than was left by the sandblasting technique. Variations in resistivity can be exponential and significantly affect the efficiency of a precipitator.

While using sandblasting techniques Applicant learned that it was preferable to screen the particles to retain particles from 10 to 20 mesh for blasting. It was also learned that the particles should be dried. As such Applicant currently screens the flue dust stock pile to collect particulate from 10 to 20 mesh and dries this particulate prior to sacking one and a half tons per sack and shipping. Larger pieces can be broken prior to screening.

Figure 4:
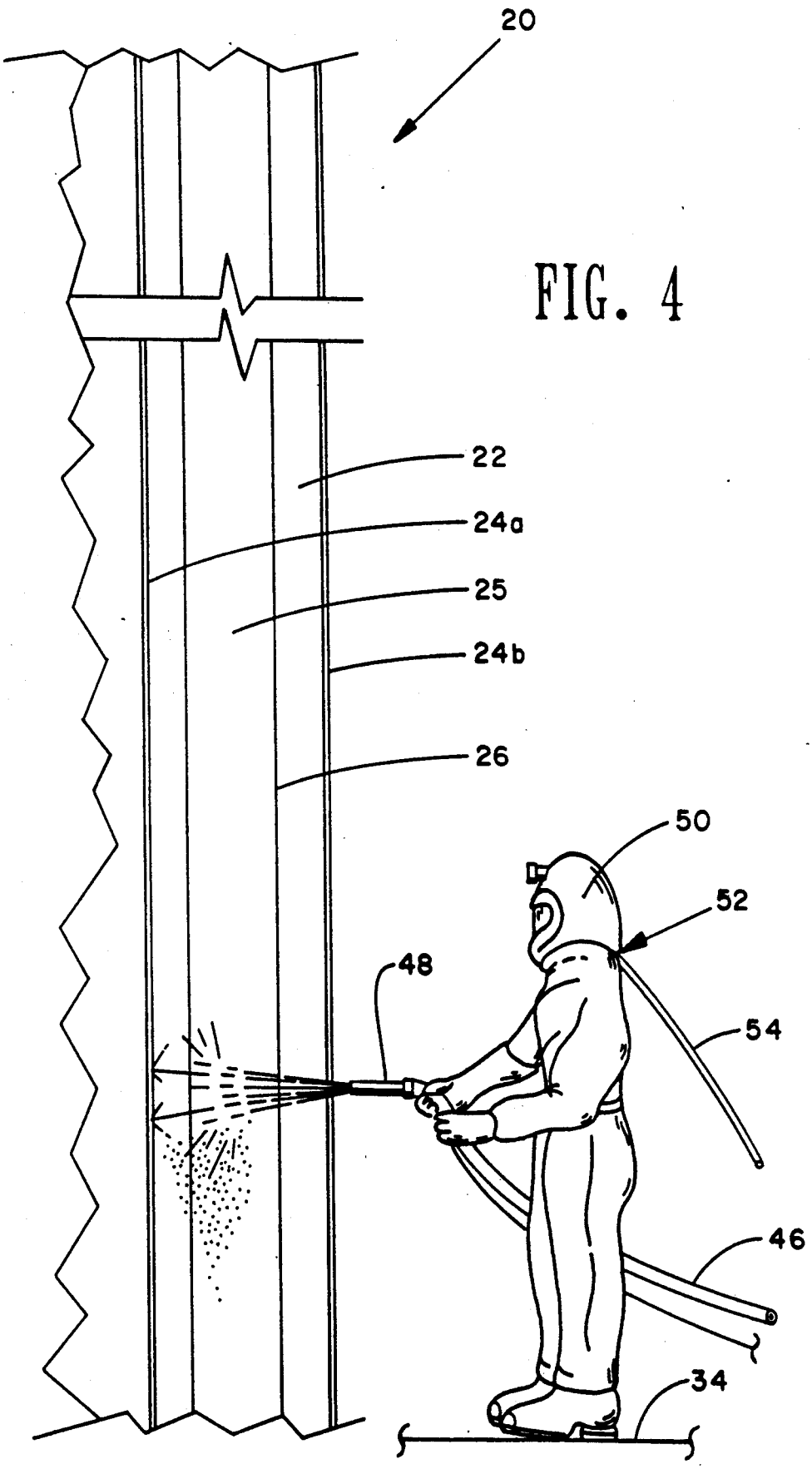
FIG. 4 is an elevational view showing a worker blasting a collection plate.

Referring to FIG. 4 a worker 50 is depicted blasting the precipitator 20. A one and one quarter inch ID hose 46 feeds the particulate to a nozzle 48. A preferable nozzle 48 used in the invention is a PTLV7 nozzle (7/16 inch nozzle) made from tungston carbide or silicone carbide. The worker 50 also has an electric pinch valve (not shown) for shut off of the blasting line 46 in the event of an emergency. The worker 50 is wearing an air respirator 52 with other safety equipment as is known to one of ordinary skill in the art. The respirator system typically uses a separate compressor, air purification and CO alarms.

When blasting a worker 50 can blast top-down or bottom-up. Vertical ribs 24*a* and 24*b* support the collection plates 22 so a worker must blast each panel section 25 between the ribs 24*a* and 24*b*. For example between each set of plates 22 the worker 50 may need to make several passes or strokes on each side between the ribs 24 and down the middle. To remove the accumulated ash while minimizing damage of the collection plates 22, wires 26 and bottles (not shown) the worker should attempt to glance the panel 25 rather than blast the panel 25 straight on. In a typical blasting procedure for an individual panel 25 between the ribs 24 the worker 50 will start blasting clear down by his toes and glance the panel back and forth moving slowly upward until blasting straight or nearly straight up. Since it is very dark the worker may be watching for sparks to see where the plate 22 is striken. After he has made a complete pass he will move on to the next section of the collector plate 22 between adjacent ribs. The air supply and the particulate supply hoses 54 and 46, respectively, should be rolled in an over/under pattern so that they do not twist while the worker 50 is moving through the precipitator. For difficult jobs the worker may remove his normal nozzle and attach an extension nozzle (not shown). For example a five foot long ⅜ inch I.D. pipe can be attached to the end of the hose as an extension nozzle.

Because the precipitators must operate more efficiently a need to clean these plants more frequently exists. Applicant will usually perform the cleaning services on the weekends when the load is down so the plant can be shut down for blasting. Using several shifts, Applicant can clean the precipitator over the weekend and the plant can be up and running more efficiently in a minimal time period. Sometimes a plant will have other maintenance difficulties resulting in two or three days down time. Because of Applicant's turnaround time, the plant can pick up the phone and contact Applicant to order a cleaning service during this down time. During the blasting procedure there is air flowing through the precipitator which is causing the worker's equipment and clothing to whip in the wind while it is dark and dusty. At the same time the worker is trying to move very quickly. The goal is to clean the maximum area of collector plates in a minimum amount of time. The workers need to be efficient in blasting while preventing unnecessary wear on the plates. Inspections are carried out before and after blasting to look for broken wires, bent wires, damaged plates and spots where accumulated ash has not been removed.

The orifice of the nozzle 48 should be at least three times larger than the size of the particulate. This is because if there are three particles trying to squeeze through the orifice a situation is created where the orifice may plug. Blasting velocities are similar to or the same as those used for sandblasting. Sandblasting velocities are in the range of 645 feet per second. To obtain the same velocities as used in sandblasting the volume, but not necessarily the weight of the particulate, blended into the air stream must be decreased due to the relatively greater density of the particulate. Normal blasting pressures range from around 105 to 120 psi through the nozzle. At an operating pressure of around 115 psi the blasting volume will be approximately 230 cubic feet per minute per nozzle.

The preferred embodiment of this invention has been shown and described above. It is to be understood that minor changes in the details, construction and arrangement of the method and composition may be made without departing from the spirit or scope of the invention as claimed. For instance, the particulate used in the invention could be used as described in other sandblasting applications as known to one or ordinary skill in the art.

What is claimed is:

1. A method of removing accumulated ash from a precipitator, which comprises the step of blasting the precipitator with air entrained with a particulate comprising:

a vitreous matter comprising wustite, spinel, larnite, bredgite and mixtures thereof.

2. The method of claim 1 wherein the vitreous matter is gritty.

3. The method of claim 1 wherein the vitreous matter has a specific gravity of 3.42.

4. The method of claim 1 wherein the vitreous matter is a fused iron ore fine.

5. The method of claim 1 wherein the vitreous matter is porous.

6. The method of claim 1, further including the steps of drying the particulate and screening the particulate to collect particulate between 10 and 20 grain prior to said step of blasting the particulate.

7. The method of claim 1, wherein the vitreous matter is a flue dust particulate.

8. The method of claim 1 wherein the vitreous matter comprises:

(a) iron, 24% by weight;
(b) manganese, 3.01% by weight;
(c) calcium, 18.46% by weight; and
(d) magnesium, 1.58% by weight.

9. A method of removing accumulated ash from a precipitator, which comprises the step of blasting the precipitator with air entrained with a particulate comprising a sintered iron ore.

10. The method of claim 9 wherein the sintered iron ore fine has:

a brittleness causing the sintered iron ore fine traveling at 645 feet per second to shatter on impact with a collection plate.

11. The method of claim 9 further including the step of screening the particulate to collect particulate between ten and twenty grain prior to said step of blasting the particulate.

* * * * *